US005608413A

United States Patent [19]

Macdonald

[11] Patent Number: 5,608,413

[45] Date of Patent: Mar. 4, 1997

[54] FREQUENCY-SELECTIVE ANTENNA WITH DIFFERENT SIGNAL POLARIZATIONS

[75] Inventor: Perry A. Macdonald, Culver City, Calif.

[73] Assignee: Hughes Aircraft Company, Los Angeles, Calif.

[21] Appl. No.: 483,360

[22] Filed: Jun. 7, 1995

[51] Int. Cl.[6] ..... H01Q 1/38; H01Q 21/30

[52] U.S. Cl. ..... 343/700 MS; 343/725; 343/767; 343/702

[58] Field of Search ..... 343/700 MS, 725, 343/702, 767; H01Q 5/00, 1/36, 21/24, 21/30

[56] References Cited

U.S. PATENT DOCUMENTS

| | | | |
|---|---|---|---|
| 4,766,440 | 8/1988 | Gegan | 343/700 MS |
| 4,771,291 | 9/1988 | Lo et al. | 343/700 MS |
| 4,775,866 | 10/1988 | Shibata et al. | 343/700 MS |

*Primary Examiner*—Michael C. Wimer

*Attorney, Agent, or Firm*—V. D. Duraiswamy; W. K. Denson-Low

[57] ABSTRACT

A slot radiator and a patch radiator are formed in a single antenna which is connected to a handheld, wireless telephone. The antenna can be pivoted to operational positions and excited to radiate linearly-polarized signals or circularly-polarized signals whose radiation patterns are respectively directed azimuthally and elevationally.

28 Claims, 5 Drawing Sheets

FREQUENCY-SELECTIVE ANTENNA WITH DIFFERENT SIGNAL POLARIZATIONS

BACKGROUND OF THE INVENTION

1. Field of the Invention

The present invention relates generally to antennas and more particularly, to antennas which are responsive to different frequencies and polarizations.

2. Description of the Related Art

By definition, polarization refers to the direction and behavior of the electric field vector in an electromagnetic signal which is radiating through free space (i.e., empty space with no electrons, ions or other objects which distort the radiation). In signals with linear polarization, the electric field vectors sinusoidally reverse their direction in a plane which is orthogonal to the radiation path but they do not rotate. If the orientation of the vectors is vertical, the signal is said to have vertical polarization; if the orientation is horizontal, the signal is said to be have horizontal polarization.

In contrast, if the direction of the electric field vectors rotates at some constant angular velocity the signal has elliptical polarization. Signals with elliptical polarization can be effectively generated by combining two linearly polarized signals which are oriented in an orthogonal relationship and which have a predetermined phase difference between their electric field vectors. Circular polarization is a special case of elliptical polarization in which the two linearly polarized signals have electric field vectors of equal magnitude and a phase difference of 90°.

Elliptical polarization may be either right-handed or left-handed. In right-handed polarization, the vector direction rotates clockwise as seen from the radiative element which radiated the signal. The vector direction rotates counter-clockwise in left-handed polarization. Antennas which are designed to receive signals which have one of these elliptical polarizations will typically tend to reject signals which have the other polarization (e.g., in an antenna which is designed to receive right-handed polarization, the gain of a signal with left-handed polarization will be significantly reduced from the gain of a signal with right-handed polarization).

When an elliptically polarized signal is reflected from a conductive surface, its rotation is reversed. That is, if a transmitted signal with right-handed polarization strikes a reflecting surface, the reflected signal will have left-handed polarization. The reflected signal will be received with less gain than the transmitted signal by an antenna which is designed to receive right-handed polarization. Consequently, signals with elliptical polarization have an inherent resistance to multipath distortion; this is one reason why satellite communication is typically conducted with circularly-polarized signals.

Various communication systems require the transmission and reception of signals with different frequencies and polarizations. For example, cellular telephone systems have conventionally divided large service areas into smaller cells which each have a terrestrial transmitter. In a particular cell, different hand-held wireless telephones communicate through the cell's transmitter on a terrestrial (cellular) frequency with linear polarization. In a satellite-based system, satellites are combined with ground-based "gateways" such as a telephone exchange or a private dispatcher to facilitate communication between widely-spaced mobile users. To communicate through the gateways, different hand-held wireless telephones communicate on an extra-terrestrial (satellite) frequency with circular polarization.

Therefore, a cellular telephone which is intended for both terrestrial and extra-terrestrial communication preferably responds to a linearly-polarized signal having a first frequency with significant azimuthal gain and responds to a circularly-polarized signal having a second frequency with significant elevational gain.

A conventional antenna structure for such a cellular telephone has two antennas which are connected by a diplexer. Each leg of the diplexer is intended for passing a different one of the frequencies and includes, therefore, a filter network which has a significant insertion loss at the other of the frequencies. Although this structure can respond to the terrestrial and extra-terrestrial signals, its additional filter networks add size and cost to cellular telephones which inherently have limited space and which are directed at a cost-conscious consumer.

Quadrafilar helical antennas (QHA) can also be designed to respond to linearly-polarized and elliptically-polarized signals. An exemplary QHA has four input terminals which must each be fed with different, predetermined phase relationships to obtain the different polarizations. Although this antenna structure can also respond to linearly-polarized and circularly-polarized signals, a diplexer is required to realize the necessary phasing. In addition, QHA gain is typically directed azimuthally which detracts from the usefulness of QHA structures in satellite communications.

SUMMARY OF THE INVENTION

The present invention is directed to a dual-frequency antenna which can respond to signals with different frequencies and polarizations and which is suitable for inexpensive, high-volume manufacturing.

These goals are achieved with a stripline circuit which is adapted to define a slot radiator and a patch radiator that are coupled to a single transmission line. Ground planes of the stripline circuit define slot radiative elements and a pair of coupling apertures. The slot radiative elements form the slot radiator and a patch radiative member is spaced from the apertures to form the patch radiator.

The transmission line is arranged to pass between the midpoints of the slot radiators to generate linearly-polarized radiation at a first signal wavelength $\lambda_1$ and is arranged to excite the apertures in quadrature, i.e., with a 90° phase difference, to generate elliptically-polarized radiation from the patch radiative element at a second wavelength $\lambda_2$. The slot radiative elements are preferably dimensioned to be resonant at a wavelength $\lambda_1$ and the patch radiative element is preferably dimensioned to be resonant at a wavelength of $\lambda_2$.

The stripline circuit includes a flexible, dielectric substrate which can be mounted to a handheld, wireless telephone. The flexible substrate serves as a hinge to permit the antenna to be pivoted from a stowed position to different operational positions which cause the linearly-polarized radiation to be radiated azimuthally and the elliptically-polarized radiation to be radiated elevationally.

The transmission line includes line segments which can be adjusted to present large impedances to the patch radiator and the slot radiator at their respective resonant wavelengths to enhance the amplitude of their excitation signals.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
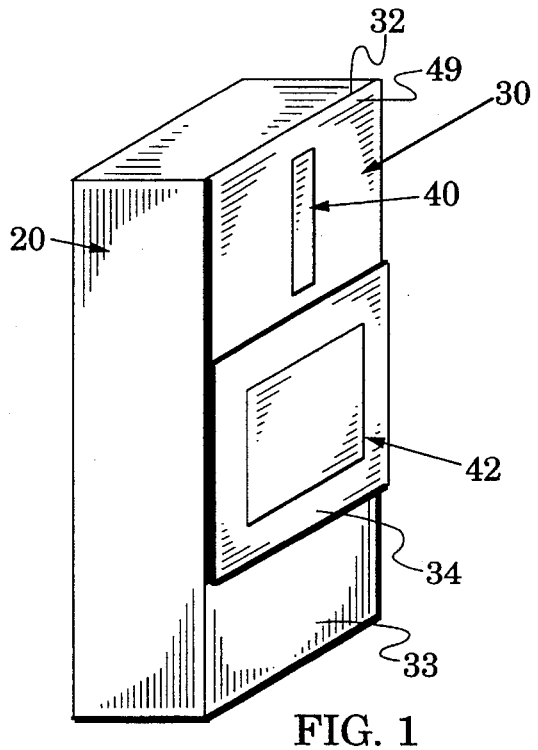
FIG. 1 is a perspective view of a frequency-selective antenna in accordance with the present invention, the antenna is illustrated in a stowed position on a handheld, wireless telephone.
Figure 2:
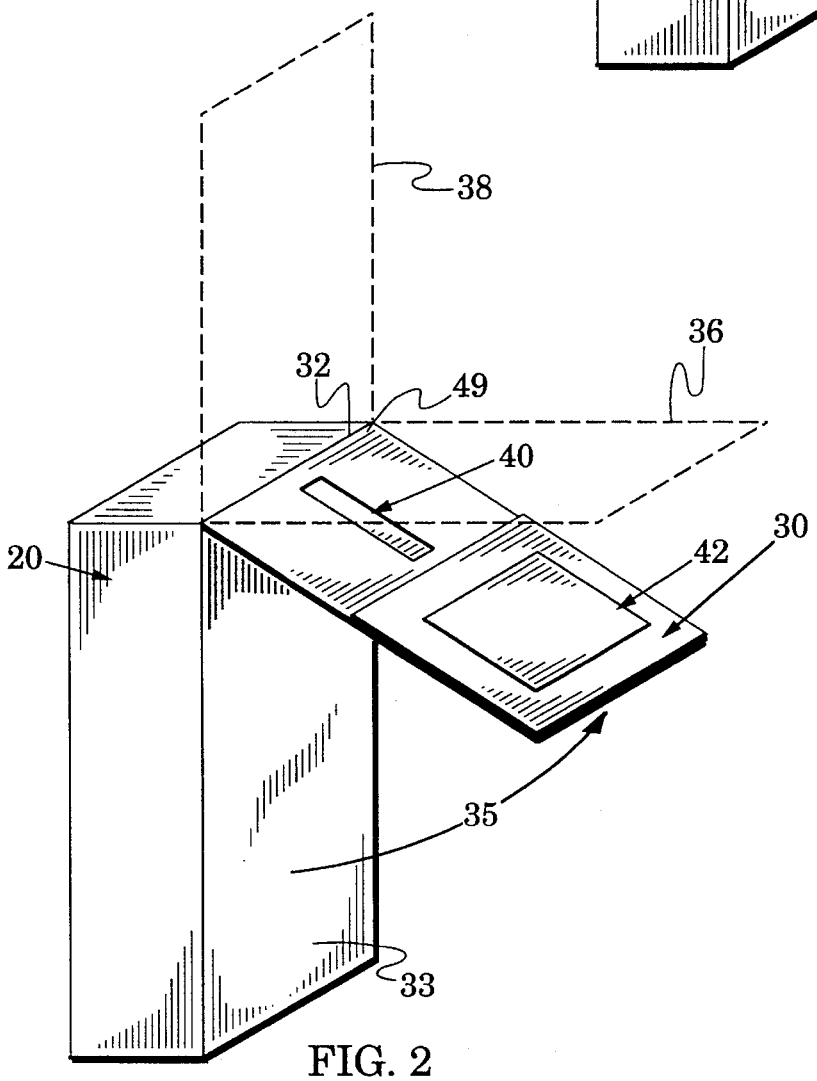
FIG. 2 is a perspective view of the frequency-selective antenna of FIG. 1 in the process of rotation to vertical and horizontal operating positions.

FIG. 1 illustrates a hand-held, wireless telephone 20 which includes a dual-frequency antenna 30. The antenna 30 is pivotably mounted to the upper edge 32 of a side 33 of the telephone 20. FIG. 1 shows the antenna in a stowed position 34 in which it abuts the telephone side 33. FIG. 2 illustrates that the antenna 30 can be rotated (as indicated by rotation arrow 35) to a horizontal operational position 36 and a vertical operational position 38.

The antenna 30 includes a slot radiator 40 and a patch radiator 42. When the antenna 30 is in its vertical operational position 38, the slot radiator 40 responds to a radio-frequency (rf) signal having a first wavelength $\lambda_1$ by radiating a linearly-polarized electromagnetic signal with a relative gain which is shown in the polar radiation pattern 46 of FIGS. 3A and 3B. The linearly-polarized signal has significant gain in all azimuthal directions. When the antenna 30 is in its horizontal operational position 36, the patch radiator 42 responds to an rf signal having a second wavelength $\lambda_2$ by radiating an elliptically-polarized electromagnetic signal with a relative gain which is shown in the polar radiation pattern 48 of FIGS. 4A and 4B. The elliptically-polarized signal has significant gain in the elevation direction.

The antenna 30 includes a flexible substrate whose upper edge 49 is connected to the upper edge 32 of the telephone 20. This connection facilitates rotation of the antenna 30 between its stowed position 34 and its operating positions 36 and 38.

A description of the operation of the antenna 30 is enhanced if it is preceded by a detailed description of the antenna's structure. Accordingly, attention is first directed to FIGS. 5–9 which show that the antenna 30 includes a lower ground plane 50, an upper ground plane 52 and a radiative patch 54. The ground planes 50 and 52 are spaced apart by a dielectric substrate 56 and the radiative patch 54 is spaced from the upper ground plane 52 by another dielectric substrate 58. A transmission line 60 is positioned between the lower ground plane 50 and the upper ground plane 52. The ground planes 50 and 52, the patch radiative element 54 and the transmission line 60 are formed from conductive sheets, e.g., copper. The dielectric substrates 56 and 58 are formed of dielectrics which preferably have low relative permittivities ($\in_r$) and low loss tangents (tan$\delta$) at the first and second operating frequencies.

The lower ground plane 50 is configured to define a slot radiative element 62 and the upper ground plane 52 is configured to define a slot radiative element 64 which is aligned with the slot radiative element 62 in the lower ground plane. As especially shown in FIG. 8, the upper ground plane 52 also defines a pair of apertures 66 and 68 which are positioned beneath the patch radiative element 54.

The transmission line 60 is configured to communicate between the telephone 20 and its antenna 30. In particular, the transmission line 60 has a first end 70 which is positioned within the telephone 20 and a second end 71 which is positioned in the antenna 30. Between its ends 70 and 71, the transmission line 60 follows a path which passes between the first and second slot radiative elements 62 and 64 and which also passes beneath the first and second apertures 66 and 68.

The substrate 56 terminates in the upper edge 49 which adjoins the upper edge 32 of the telephone's side 33. The substrate 56 is formed of a flexible dielectric so that the edge 49 effectively forms a hinge which permits the antenna 30 to be swung between the stowed position 34 of FIG. 1 and the operational positions 36 and 38 of FIG. 2, e.g., as indicated by broken-line interim antenna positions 80 and 82 in FIG. 6.

The arrangement of the transmission line 60 between the lower ground plane 50 and the upper ground plane 52 belongs to a conventional microwave structural type which is typically referred to as "stripline". In this particular stripline, the substrate 56 sets the spacing between the ground planes 50 and 52 and positions the transmission line 60 (in an exemplary fabrication method, the substrate 56 is formed of two layers which are bonded on each side of the transmission line 60). In effect, a stripline circuit is adapted to define the slot radiator 40 and the patch radiator 42. The spaced ground planes 50 and 52 and their slot radiative elements 62 and 64 form the slot radiator 40 which is directed to the radiation of signals that have a wavelength of $\lambda_1$. Accordingly, the slot radiative elements 62 and 64 are dimensioned to be resonant at a wavelength of $\lambda_1$, e.g., the width 91 (shown in FIG. 5) of the slot radiative elements is selected to be $\lambda_1/2$.

Electrically, slot radiative elements are the inverse equivalent of metal dipole radiative elements, i.e., one is formed from the other by reversing their conductive and dielectric parts. Therefore, if the transmission line 60 is arranged to feed the slot radiative elements 62 and 64 at the middle of their length 91, they radiate a linearly-polarized electromagnetic signal whose polarization is parallel with the elements' length 91 as indicated by the broken-line arrow 92 in FIG. 5. The signal coupling is enhanced if the transmission line 60 and the slot radiative elements 62 and 64 are orthogonally arranged in the region where they intersect.

The patch radiative element 54 and the first and second apertures 66 and 68 of the ground plane 52 form the patch radiator 42 which is directed to the radiation of signals which have a wavelength of $\lambda_2$. Accordingly, the radiative element 54 is dimensioned to be resonant at a wavelength of $\lambda_2$, e.g., its transverse dimensions 95 and 96 (shown in FIG. 5) are selected to be $\lambda_2/2$.

The apertures 66 and 68 couple signals between the transmission line 60 and the patch radiative element 54. In particular, the apertures 66 and 68 couple respectively to transmission line segments 98 and 99 which lie directly beneath them. Signals which are coupled from the line segment 98 cause the patch radiative element 54 to emit a linearly-polarized radiation. The direction of this polarization is parallel with the path of the line segment 98 as indicated by the broken-line arrow 100 in FIG. 5. Signals which are coupled from the line segment 99 also cause the patch radiative element 54 to emit a linearly-polarized radiation. The direction of this latter polarization is parallel with the path of the line segment 99 as indicated by the broken-line arrow 101 in FIG. 5.

If the two linearly-polarized radiations have a 90° difference in phase, they will combine to form an elliptically-polarized radiation. Accordingly, the distance along the transmission line 60 between the line segments 98 and 99 is preferably $\lambda_2/4$, i.e., the apertures 66 and 68 are excited in quadrature. The signal coupling and radiation are enhanced if the transmission line segments 98 and 99 are orthogonal and they are each orthogonally arranged with their respective aperture. In the arrangement of FIGS. 5–9, the radiation from the patch radiator 42 will have circular polarization because the apertures 66 and 68 are similar and their arrangements with their transmission line segments 98 and 99 are also similar.

Figure 3B:
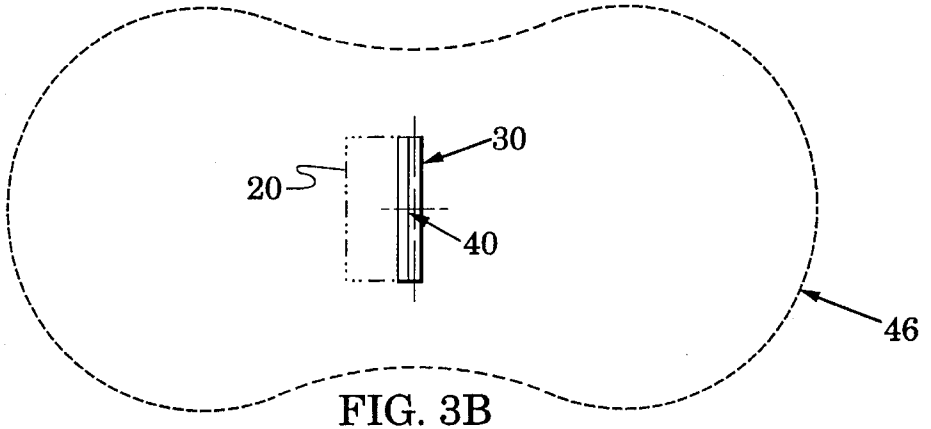
FIG. 3B is a top plan view of the polar radiation pattern and frequency-selective antenna of FIG. 3A.
Figure 3A:
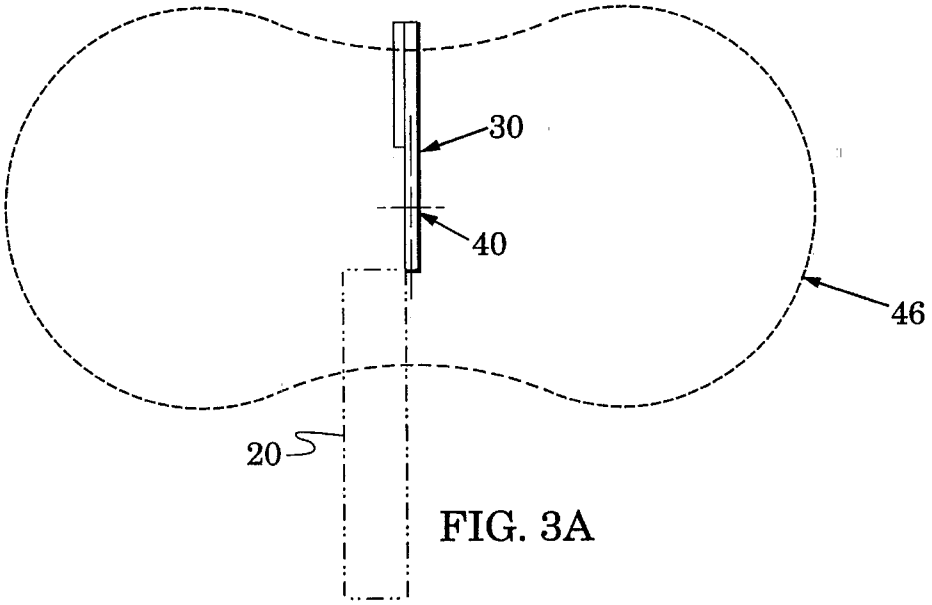
FIG. 3A is a side elevation view of the frequency-selective antenna of FIG. 2 in its vertical operating position combined with a polar radiation pattern that is obtained with a first signal frequency.
Figure 4A:
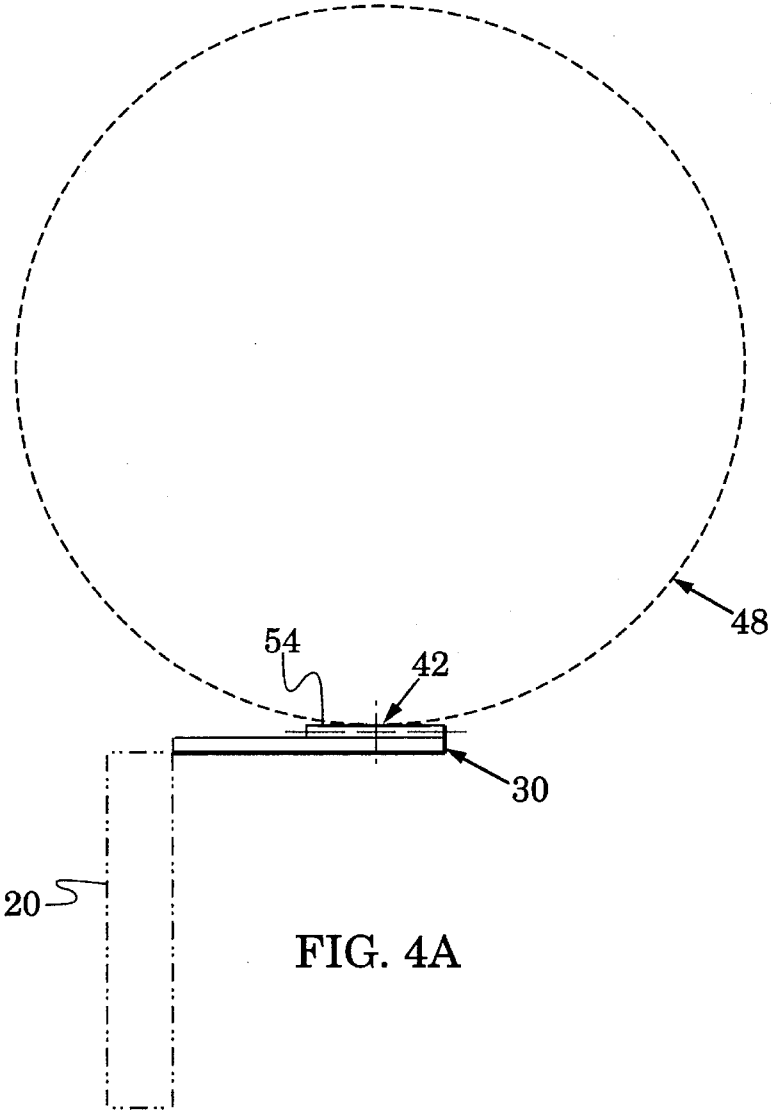
FIG. 4A is a side elevation view of the frequency-selective antenna of FIG. 2 in its horizontal operating position combined with a polar radiation pattern that is obtained with a second signal frequency.
Figure 4B:
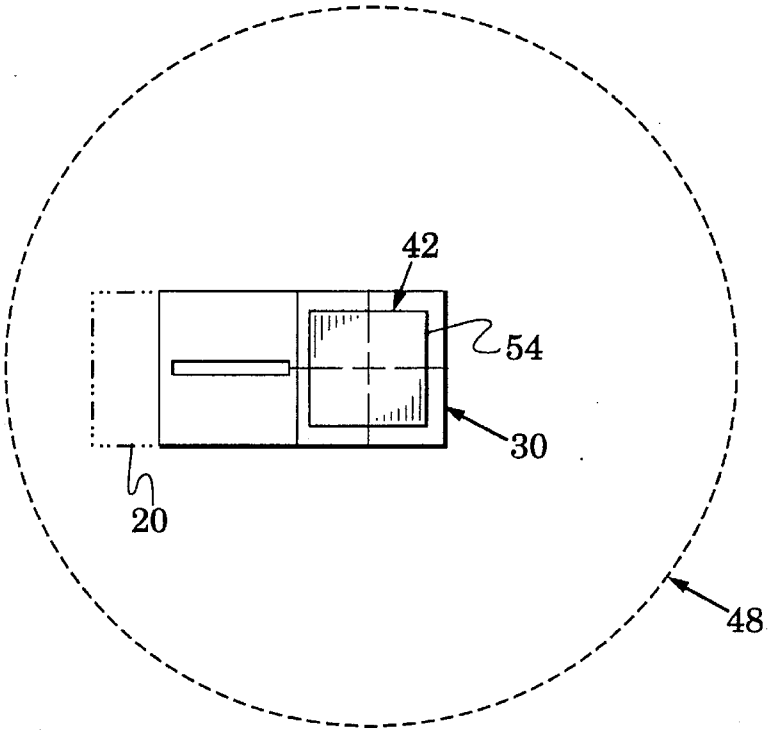
FIG. 4B is a top plan view of the polar radiation pattern and frequency-selective antenna of FIG. 4A.

When it is desired to operate the telephone 20, the antenna 30 is mechanically pivoted from its stowed position 34 of FIG. 1 to either of its operational positions 36 and 38 of FIG. 2. In electrical operation of the antenna 30, a signal is then fed into the end 70 of the transmission line 60 from a transceiver which is positioned within the telephone 20. If the signal has a wavelength of $\lambda_1$, it excites the slot radiator 40 which is resonant at this wavelength. Therefore, radiation at a wavelength of $\lambda_1$ is directed away from each of the slot radiative elements 62 and 64 as indicated in the polar radiation pattern 46 of FIGS. 3A and 3B. Because the antenna 30 includes only one patch radiator 42 (in contrast with an array of radiators), the beam width of the radiation from each of the antenna 30 will be very broad, e.g., on the order of 100°. Therefore, although the radiation gain will have a maximum in a direction which is orthogonal to the ground planes 50 and 52, there will be significant radiation gain in all azimuthal directions as indicated in FIG. 3B.

In contrast, if the signal from the telephone 20 has a wavelength of $\lambda_2$, it excites the patch radiator 42 which is resonant at this wavelength. Therefore, radiation at a wavelength of $\lambda_2$ is directed orthogonally away from the patch radiative element 54 as indicated in the polar radiation pattern 48 of FIGS. 4A and 4B. Because the antenna 30 includes only one patch radiator 42 (in contrast with an array of radiators), the radiation beam width will again be very broad. The gain will have a maximum in a direction that is orthogonal to the plane of the patch radiative element 54, i.e. the radiation is directed primarily in the elevation direction.

Figure 5:
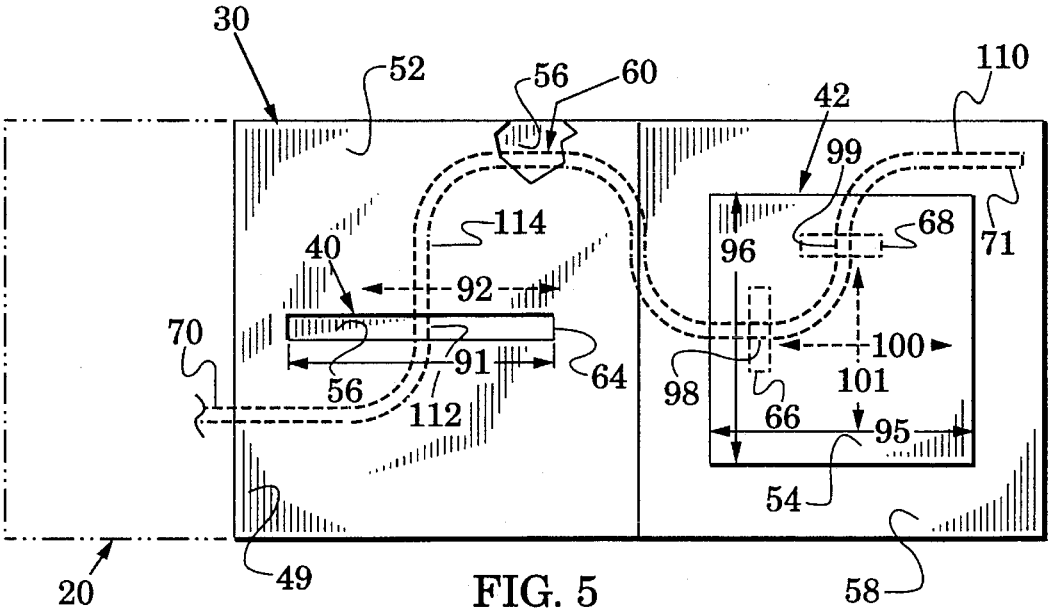
FIG. 5 is a top plan view of the frequency-selective antenna of FIG. 2 when it is in its horizontal operating position.
Figure 6:
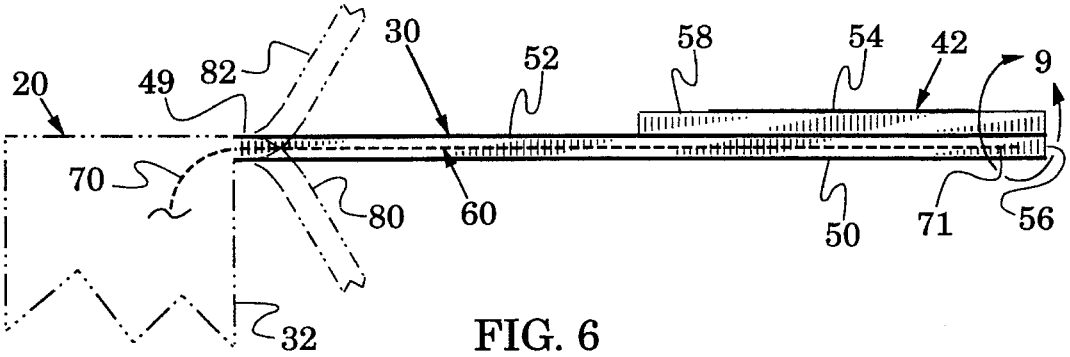
FIG. 6 is a side elevation view of the frequency-selective antenna of FIG. 5.
Figure 7:
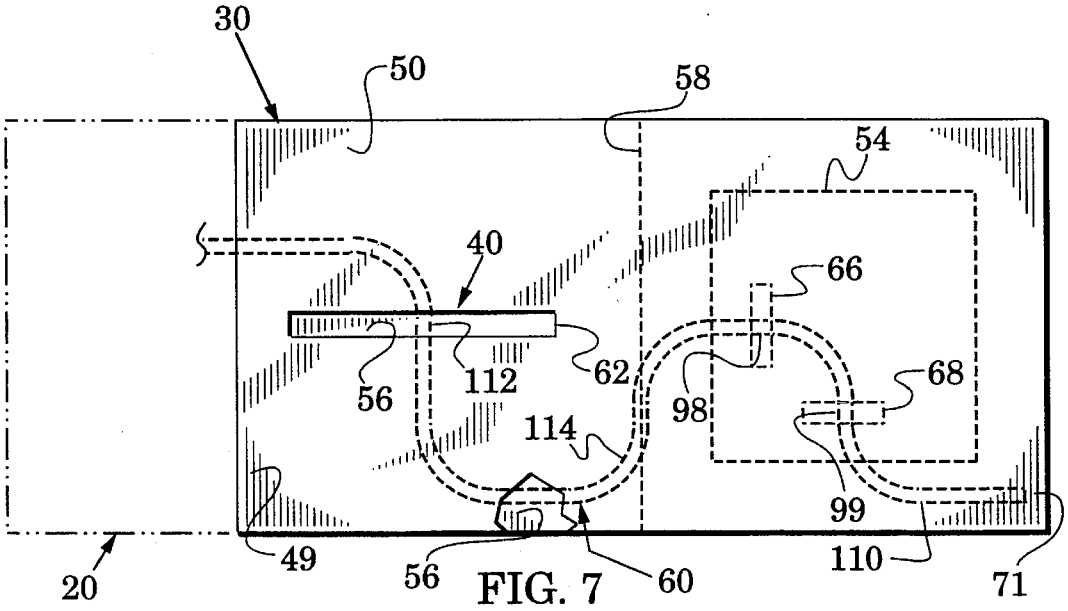
FIG. 7 is a bottom plan view of the frequency-selective antenna of FIG. 5.
Figure 8:
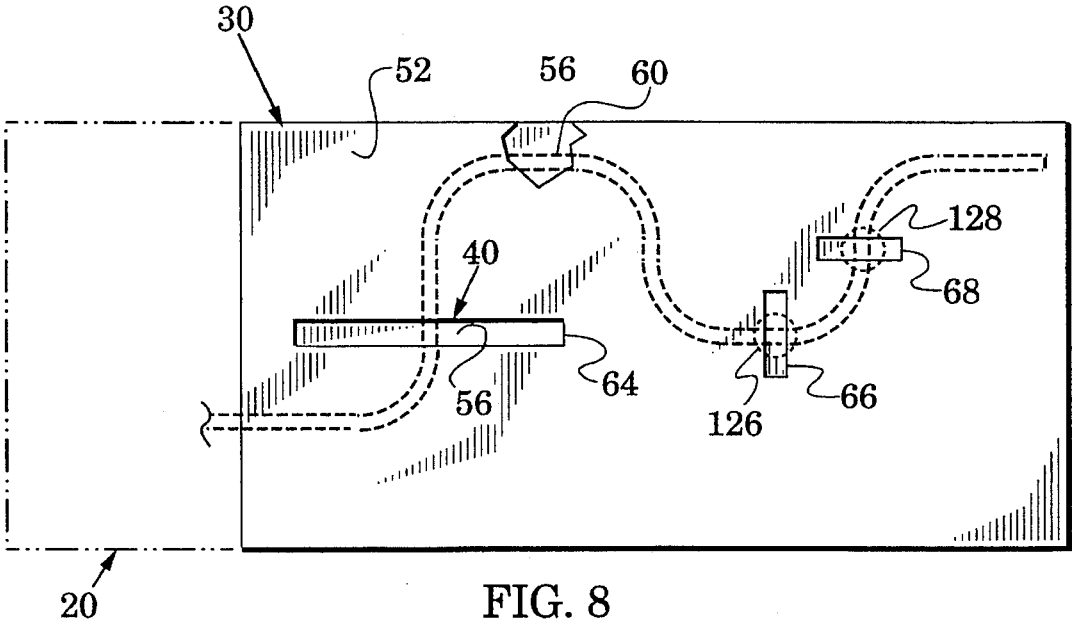
FIG. 8 is a view similar to FIG. 5, in which a patch radiative element and its substrate have been removed for clarity of illustration.

As shown in FIG. 5 and 7, the transmission line 60 includes a segment 110 which connects the segment 99 and a load impedance at the line end 71. When the patch radiator 42 is being excited by a signal of wavelength $\lambda_2$, the segment 110 preferably presents a large impedance to the segment 99 (and aperture 68) to enhance the signal magnitude on the segment 99. This is accomplished by arranging the load impedance at the end 71 to be an open circuit (as shown in FIG. 6) and by forming the length of the segment 110, e.g., $\lambda_2/2$, to set a predetermined impedance. As is well known in the stripline art, a length $\lambda_2/2$ of transmission line will transform the open circuit at the end 71 to an open circuit at the line segment 99.

Figure 9:
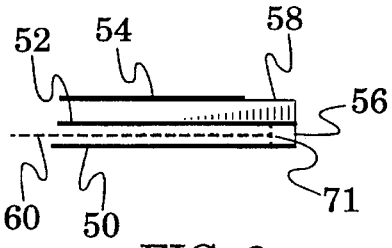
FIG. 9 is a view of the structure within the line 9 of FIG. 6, which shows another transmission line embodiment.

Alternatively, the load impedance at the end 71 can be arranged to be a short circuit by connecting it to one or both of the ground planes 50 and 52 as shown in FIG. 9. In this arrangement, the length of the segment 110 is then set to be approximately $\lambda_2/4$. As is well known in the stripline art, this length of transmission line will transform the short circuit at the end 71 to an open circuit at the line segment 99.

When the patch radiator 42 is being excited by a signal of wavelength $\lambda_2$, the slot radiative elements 62 and 64 will appear to be either capacitive (if $\lambda_2$ is greater than $\lambda_1$) or inductive (if $\lambda_2$ is less than $\lambda_1$). The effect of this inductive or capacitive reactance upon the patch radiator 42 can be reduced by reducing the width of the slot radiative elements 62 and 64 (the dimension orthogonal to the length 91) and by increasing the difference between the wavelengths $\lambda_1$ and $\lambda_2$. For example, the slot width can be set to the $0.01\lambda_1$ and the operating frequencies selected to be 1200 MHz and 900 MHz which cause $\lambda_2$ to be approximately ⅓ greater than $\lambda_1$.

As shown in FIG. 5 and 7, the transmission line 60 includes a segment 112 which is directly between the slot radiative elements 62 and 64. The line 60 also includes a segment 114 which connects the segments 112 and 98. When the slot radiator 40 is being excited by a signal of wavelength $\lambda_1$, the segment 114 preferably presents a large impedance to segment 112 to enhance the signal magnitude that is generated across the slot radiative elements 62 and 64. The patch radiator 42 will have a specific impedance to signals with a wavelength of $\lambda_1$. As is well known in the stripline art, this specific impedance can be transformed into the same or a larger impedance by a proper selection of the length of the transmission line segment 114, i.e., set to $\lambda_1/n$ wherein n is chosen to present a predetermined impedance at a signal wavelength of $\lambda_1$ to the segment 112. Thus, the lengths of the line segments 110 and 114 can be selected to enhance the signal radiation from the slot radiator 40 and the patch radiator 42.

Although effective embodiments of the antenna 30 can be formed without the lower ground plane 50, it is preferably included to decrease signal loss from the transmission line 60 and to enhance the azimuthal radiation of signal the slot radiative element 64 by addition of the second radiative element 62.

Figure 10:
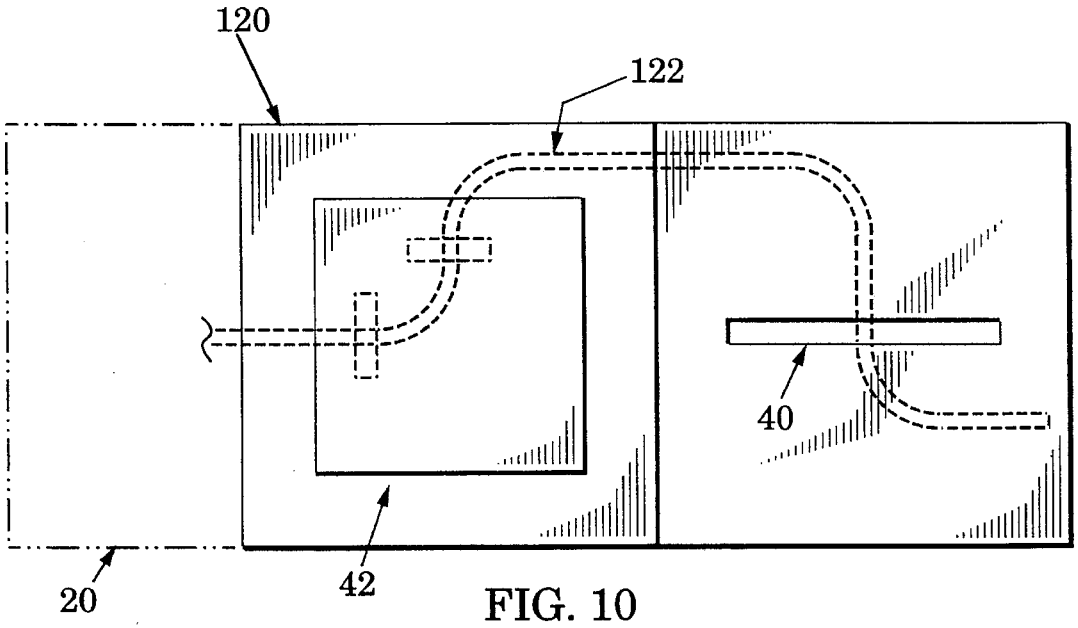
FIG. 10 is a view similar to FIG. 5, which illustrates another frequency-selective antenna embodiment.

The teachings of the invention can be extended to an antenna 120 which is shown in FIG. 10. The antenna 120 is similar to the antenna 30 of FIG. 5 but the positions of the slot radiator 40 and the patch radiator 42 have been interchanged and the transmission line 60 is replaced by a transmission line 122 which is arranged to couple to each of the radiators. As in the antenna 30 of FIGS. 1–9, a proper selection of the lengths of line segments in the transmission line 120 can be made to enhance the radiation from each of the radiators when they are excited by their respective signals.

The dielectric substrates 56 and 58 of the antennas 30 and 120 are preferably formed from dielectrics, e.g., duroid, which have low relative permittivities ($\epsilon_r$) and low loss tangents (tanδ) at microwave operating frequencies. In addition, the dielectric substrate 56 is preferably selected from dielectrics such as polyimide (e.g., as manufactured under the trademark Kapton by E. I. du Pont de Nemours & Company) which are flexible and which can be flexed a large number of times without failure.

The coupling apertures 66 and 68 are not intended to be resonant at a wavelength of $\lambda_2$ but need only be large enough to insure that sufficient energy is coupled between the transmission line 60 and the radiative patch element 54. Accordingly, the aperture dimensions are generally much less than $\lambda_2/2$. Although the coupling apertures 66 and 68 are shown to be slot-shaped in the antennas 30 and 120, other well-known coupling shapes, e.g., the circular apertures 126 and 128 shown in broken lines in FIG. 5, can be employed in other antenna embodiments.

Antennas in accordance with the invention are responsive to terrestrial and extra-terrestrial signals that have different radiation polarizations. Because they can be formed from simple, conventional stripline structures with conventional photolithographic techniques, these antennas are suitable for inexpensive, high-volume fabrication.

As is well known, antennas have the property of reciprocity, i.e., the characteristics of a given antenna are the same whether it is transmitting or receiving. The use of terms such as radiative element and radiation in the description and claims are for convenience and clarity of illustration and are not intended to limit structures taught by the invention. An antenna which can generate dual-frequency radiation can inherently receive the same dual-frequency radiation.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A dual-frequency antenna for operation with first and second rf signals which respectively have $\lambda_1$ and $\lambda_2$ wavelengths, comprising:

a slot radiator configured to radiate said first rf signal with linear polarization;

a patch radiator configured to radiate said second rf signal with elliptical radiation; and a transmission line configured to carry said first and second rf signals and arranged to couple said first rf signal to said slot radiator and to couple said second rf signal to said patch radiator;

wherein;

said slot radiator includes a ground plane configured to define a slot radiative element;

said transmission line is spaced from a first side of said ground plane; and said slot radiative element is positioned to couple said first rf signal between said transmission line and free space.

2. The antenna of claim 1, wherein said slot radiator has a length which is substantially $\lambda_1/2$.

3. The antenna of claim 2, wherein said patch radiator includes:

a patch radiative element spaced from a second side of said ground plane; and first and second apertures defined by said ground plane and positioned to couple said second rf signal between said transmission line and said patch radiative element.

4. The antenna of claim 3, wherein said patch radiative element has a width which is substantially $\lambda_2/2$.

5. The antenna of claim 3, wherein:

said transmission line has first and second segments;

said first and second apertures are respectively coupled to said first and second segments; and said first and second segments are spaced apart on said transmission line by substantially $\lambda_2/n$ wherein n is chosen to obtain a predetermined elliptical polarization.

6. The antenna of claim 5, wherein n substantially equals 4 to obtain circular polarization.

7. A dual-frequency atenna for operation with first and second rf signals which respectively have $\lambda_1$ and $\lambda_2$ wavelengths, comprising:

a slot radiator configured to radiate said first rf signal with linear polarization;

a patch radiator configured to radiate said second rf signal with elliptical radiation; and a transmission line configured to carry said first and second rf signals and arranged to coupled said first rf signal to said slot radiator and to couple said second rf signal to said patch radiator;

wherein said patch radiator includes:

a ground plane configured to define first and second aperatures; and a patch radiative element spaced from a first side of said ground plane;

and wherein said transmission line is spaced from a second side of said ground plane; and said first and second aperatures are positioned to coupled said second rf signal between said transmission line and said patch radiative element.

8. The atenna of claim 7 wherein said patch radiative element has a length which is substantially $\lambda_2/2$.

9. The antenna of claim 7, wherein:

said transmission line has first and second segments;

said first and second apertures are respectively coupled to said first and second segments; and said first and second segments are spaced apart on said transmission line by substantially $\lambda_2/n$ wherein n is chosen to obtain a predetermined elliptical polarization.

10. The antenna of claim 9, wherein n substantially equals 4 to obtain circular polarization.

11. The antenna of claim 7, wherein:

said slot radiator includes a slot radiative element defined by said ground plane; and said slot radiative element is positioned to couple said first rf signal between between said transmission line and free space.

12. The antenna of claim 11, wherein said slot radiative element has a length which is substantially $\lambda_1/2$.

13. A dual-frequency antenna for operation with first and second rf signals which respectively have $\lambda_1$ and $\lambda_2$ wavelengths, comprising:

a first ground plane;

a second ground plane spaced from said first ground plane;

a patch radiative element spaced from said first ground plane and configured to radiate said second rf signal; and a transmission line positioned between said first and second ground planes to carry said first and second rf signals;

wherein;

said first ground plane is configured to define first and second apertures;

one of said first and second ground planes is configured to define a first slot radiative element;

said first slot radiative element is configured to radiate said first rf signal with linear polarization and is positioned to couple said first rf signal between said transmission line and free space; and said first and second apertures are each configured and positioned to couple said second rf signal between said transmission line and said patch radiative element for elliptically-polarized radiation.

14. The antenna of claim 13, wherein:

the other of said first and second ground planes is configured to define a second slot radiative element; and said second slot radiative element is configured to radiate said first rf signal with linear polarization and is positioned to couple said first rf signal between said transmission line and free space.

15. The antenna of claim 13, wherein:

said transmission line has first and second segments;

said first and second apertures are respectively coupled to said first and second segments; and said first and second segments are spaced apart on said transmission line by substantially $\lambda_2/n$ wherein n is chosen to obtain a predetermined elliptical polarization.

16. The antenna of claim 15, wherein n substantially equals 4 to obtain circular polarization.

17. The antenna of claim 13, wherein:

said transmission line has first and second segments;

said patch radiative element is coupled to said first segment;

said second segment has an end which adjoins said second segment and another end which terminates in a load impedance; and said second segment has a length of substantially $\lambda_2/n$ wherein n is chosen to present a predetermined impedance at a signal wavelength of $\lambda_2$ to said second segment.

18. The antenna of claim 17, wherein said load impedance is an open circuit and n substantially equals 2.

19. The antenna of claim 17, wherein said load impedance is a short circuit and n substantially equals 4.

20. The antenna of claim 13, wherein:

said transmission line has first and second segments;

said first slot radiative element is coupled to said first segment;

said second segment has an end which adjoins said first segment and another end which terminates in a load impedance; and said second segment has a length of substantially $\lambda_1/n$ wherein n is chosen to present a predetermined impedance at a signal wavelength of $\lambda_1$ to said second segment.

21. The antenna of claim 20, wherein said load impedance is an open circuit and n substantially equals 2.

22. The antenna of claim 20, wherein said load impedance is a short circuit and n substantially equals 4.

23. The antenna of claim 13, wherein:

said transmission line has first, second. and third segments with said second segment connecting said first and third segments;

said first slot radiative element is coupled to said first segment;

said patch radiative element is coupled to said third segment; and said second segment has a length of substantially $\lambda_1/n$ wherein n is chosen to present a predetermined impedance at a signal wavelength of $\lambda_1$ to said first segment.

24. The antenna of claim 23, wherein said transmission line has a fourth segment which has an end that adjoins said third segment and another end which terminates in a load impedance; and said fourth segment has a length of substantially $\lambda_2/n$ wherein n is chosen to present a predetermined impedance at a signal wavelength of $\lambda_2$ to said third segment.

25. The antenna of claim 13, wherein:

said transmission line has first, second and third segments with said second segment connecting said first and third segments;

said patch radiative element is coupled to said first segment;

said first slot radiative element is coupled to said third segment; and said second segment has a length of substantially $\lambda_2/n$ wherein n is chosen to present a predetermined impedance at a signal wavelength of $\lambda_2$ to said first segment.

26. The antenna of claim 25, wherein said transmission line has a fourth segment which has an end that adjoins said third segment and another end which terminates in a load impedance; and said fourth segment has a length of substantially $\lambda_1/n$ wherein n is chosen to present a predetermined impedance at a signal wavelength of $\lambda_1$ to said third segment.

27. The antenna of claim 13, further including:

a first dielectric substrate positioned between said first and second ground planes; and a second dielectric substrate positioned between said patch radiative element and said first ground plane.

28. A dual-frequency antenna for operation with first and second rf signals which respectively have $\lambda_1$ and $\lambda_2$ wavelengths, comprising:

slot radiator configured to radiate said first rf signal with linear polarization;

a patch radiator spaced from said slot radiator and configured to radiate said second rf signal with elliptical radiation; and a transmission line configured to carry said first and second rf signals and arranged to coupled said first rf signal to said slot radiator and to couple said second rf signal to said patch radiator; and further including a ground plane and wherein:

said slot radiator includes a slot radiative element formed by said ground plane to have a length of substantially $\lambda_1/2$;

said transmission line is spaced from a first side of said ground plane;

said slot radiative element is positioned to couple said first rf signal between said transmission line and free space;

said patch radiator includes;

a) first end second apertures formed by said ground plane; and b) a patch radiative element spaced from a second side of said ground plane and having length of substantially $\lambda_2/2$; and said first and second apertures are positioned to couple said second rf signal between said transmission line and said patch radiative element.

* * * * *